US007923641B2

(12) United States Patent
Smith et al.

(10) Patent No.: US 7,923,641 B2
(45) Date of Patent: Apr. 12, 2011

(54) COMMUNICATION CABLE COMPRISING ELECTRICALLY ISOLATED PATCHES OF SHIELDING MATERIAL

(75) Inventors: Delton C. Smith, Greenwood, SC (US); James S. Tyler, Woodstock, GA (US); Christopher McNutt, Woodstock, GA (US)

(73) Assignee: Superior Essex Communications LLP, Atlanta, GA (US)

( * ) Notice: Subject to any disclaimer, the term of this patent is extended or adjusted under 35 U.S.C. 154(b) by 112 days.

(21) Appl. No.: 12/313,914

(22) Filed: Nov. 25, 2008

(65) Prior Publication Data

US 2009/0173511 A1 Jul. 9, 2009

Related U.S. Application Data

(63) Continuation-in-part of application No. 11/502,777, filed on Aug. 11, 2006, now abandoned.

(51) Int. Cl.
*H01B 11/02* (2006.01)

(52) U.S. Cl. ..... 174/113 R; 174/36

(58) Field of Classification Search ..... 174/36, 174/108, 109, 113 R

See application file for complete search history.

(56) References Cited

U.S. PATENT DOCUMENTS

| | | | | |
|---|---|---|---|---|
| 3,373,475 | A | 3/1968 | Petersen | |
| 4,604,497 | A | 8/1986 | Bell et al. | |
| 4,638,272 | A | 1/1987 | Ive | |
| 5,006,806 | A | 4/1991 | Rippingale | |
| 5,106,175 | A | 4/1992 | Davis et al. | |
| 5,114,517 | A | 5/1992 | Rippingale et al. | |
| 6,687,437 | B1 | 2/2004 | Starnes et al. | |
| 6,737,574 | B2 | 5/2004 | Sylvia et al. | |
| 6,770,819 | B2 * | 8/2004 | Patel | 174/113 R |
| 6,850,161 | B1 | 2/2005 | Elliott | |
| 7,173,189 | B1 * | 2/2007 | Hazy et al. | 174/110 R |
| 7,332,676 | B2 | 2/2008 | Sparrowhawk | |
| 7,335,837 | B2 | 2/2008 | Pfeiler et al. | |
| 2006/0048961 | A1 | 3/2006 | Pfeiler et al. | |
| 2007/0037419 | A1 * | 2/2007 | Sparrowhawk | 439/98 |

FOREIGN PATENT DOCUMENTS

WO WO 2006/105166 A2 5/2006

OTHER PUBLICATIONS

"Product Catalogue" 2 pgs., Enterprise Cabling R&M, May 2006.
"Draka" 12 pgs., Draka Comteq, Cable Solutions, Data cables, Sep. 27, 2006.
"10 Gigabit Ethernet Solutions" 8 pgs., R&M Convincing Cabling Solutions.
Wetzikon, "R&M: The Rising Stars in Copper Cabling" 2 pgs., Sep. 1, 2005.
"R&M Star Real 10" 2 pgs., Mar. 2006.
"Connections 29" 36 pgs., Sep. 2005.

* cited by examiner

*Primary Examiner* — Chau N Nguyen
(74) *Attorney, Agent, or Firm* — King & Spalding

(57) ABSTRACT

A tape can comprise a two-sided strip of dielectric material, with patches of electrical conductive material adhering to each side. Patches on one side can be longitudinally offset from patches on the opposite side. The patches can be electrically isolated from one another. The tape can be wrapped around one or more conductors, such as wires that transmit data, to provide electrical or electromagnetic shielding. The patches can circumferentially encase the conductors, with patches on one side of the tape covering gaps on the other side of the tape. The tape can be wrapped around the conductors so that an edge of a patch spirals about the conductors in a rotational direction opposite to any twisting of the conductors. The resulting cable can have a shield that is electrically discontinuous between opposite ends of the cable.

26 Claims, 8 Drawing Sheets

COMMUNICATION CABLE COMPRISING ELECTRICALLY ISOLATED PATCHES OF SHIELDING MATERIAL

CROSS REFERENCE TO RELATED APPLICATIONS

This application is a continuation-in-part of and claims priority to U.S. patent application Ser. No. 11/502,777, filed Aug. 11, 2006 now abandoned in the name of Delton C. Smith et al. and entitled "Method and Apparatus for Fabricating Noise-Mitigating Cable," the entire contents of which are hereby incorporated herein by reference.

This application is related to the co-assigned U.S. patent application entitled "Communication Cable Comprising Electrically Discontinuous Shield Having Nonmetallic Appearance" filed concurrently herewith under and assigned U.S. patent application No. 12/313,910, the entire contents of which are hereby incorporate herein by reference.

FIELD OF THE TECHNOLOGY

The present invention relates to communication cables that are shielded from electromagnetic radiation and more specifically to a communication cable shielded with patches of conductive material adhering to a dielectric film that is wrapped around wires of the cable.

BACKGROUND

As the desire for enhanced communication bandwidth escalates, transmission media need to convey information at higher speeds while maintaining signal fidelity and avoiding crosstalk. However, effects such as noise, interference, crosstalk, alien crosstalk, and alien elfext crosstalk can strengthen with increased data rates, thereby degrading signal quality or integrity. For example, when two cables are disposed adjacent one another, data transmission in one cable can induce signal problems in the other cable via crosstalk interference.

One approach to addressing crosstalk between communication cables is to circumferentially encase each cable in a continuous shield, such as a flexible metallic tube or a foil that coaxially surrounds the cable's conductors. However, shielding based on convention technology can be expensive to manufacture and/or cumbersome to install in the field. In particular, complications can arise when a cable is encased by a shield that is electrically continuous between the two ends of the cable.

In a typical application, each cable end is connected to a terminal device such as an electrical transmitter, receiver, or transceiver. The continuous shield can inadvertently carry voltage along the cable, for example from one terminal device at one end of the cable towards another terminal device at the other end of the cable. If a person contacts the shielding, the person may receive a shock if the shielding is not properly grounded. Accordingly, continuous cable shields are typically grounded at both ends of the cable to reduce shock hazards and loop currents that can interfere with transmitted signals.

Such a continuous shield can also set up standing waves of electromagnetic energy based on signals received from nearby energy sources. In this scenario, the shield's standing wave can radiate electromagnetic energy, somewhat like an antenna, that may interfere with wireless communication devices or other sensitive equipment operating nearby.

Accordingly, to address these representative deficiencies in the art, what is needed is an improved capability for shielding conductors that may carry high-speed communication signals. Another need exists for a method and apparatus for efficiently manufacturing communication cables that are resistant to noise. Yet another need exists for a cable construction that effectively suppresses crosstalk and/or other interference without providing an electrically conductive path between ends of the cable. A capability addressing one or more of such needs would support increasing bandwidth without unduly increasing cost or installation complexity.

SUMMARY

The present invention supports providing shielding for cables that may communicate data or other information.

In one aspect of the present invention, a tape can comprise a narrow strip of dielectric material, for example in the form of a film, with two sides. Electrically conductive areas or patches can be disposed against each side of the tape, with the conductive patches electrically isolated from one another. The patches can comprise aluminum, copper, a metallic substance, or some other material that readily conducts electricity. The patches can be printed, fused, transferred, bonded, vapor deposited, imprinted, coated, or otherwise attached to or disposed adjacent to the strip of dielectric material. On each side of the tape, electrically isolating gaps can be disposed between adjacent patches. The patches on one side of the tape can cover the gaps on the other side of the tape. The tape can be wrapped around signal conductors, such as wires that transmit data, to provide electrical or electromagnetic shielding for the conductors. The combination of sections or segments of conductive shielding can substantially circumscribe or circumferentially encase the signal conductors. That is, any significant circumferential area not covered by patches on one side of the tape can be covered by patches on the opposite side of the tape.

The tape and/or the resulting shield can be electrically discontinuous between opposite ends of a cable. While electricity can flow freely in each individual section of shielding, the isolating gaps can provide shield discontinuities for inhibiting electricity from flowing in the shielding material along the full length of the cable.

The discussion of shielding conductors presented in this summary is for illustrative purposes only. Various aspects of the present invention may be more clearly understood and appreciated from a review of the following detailed description of the disclosed embodiments and by reference to the drawings and the claims that follow. Moreover, other aspects, systems, methods, features, advantages, and objects of the present invention will become apparent to one with skill in the art upon examination of the following drawings and detailed description. It is intended that all such aspects, systems, methods, features, advantages, and objects are to be included within this description, are to be within the scope of the present invention, and are to be protected by the accompanying claims.

BRIEF DESCRIPTION OF THE DRAWINGS

FIG. 3, are a flowchart depicting an exemplary process for manufacturing cable in accordance with certain embodiments of the present invention.

FIG. 4, are illustrations of exemplary segmented tapes comprising conductive patches disposed on opposite sides of a dielectric film in accordance with certain embodiments of the present invention.

FIG. 5, are illustrations, from different viewing perspectives, of an exemplary segmented tape comprising conductive patches disposed on opposite sides of a dielectric film in accordance with certain embodiments of the present invention.

Figure 1:
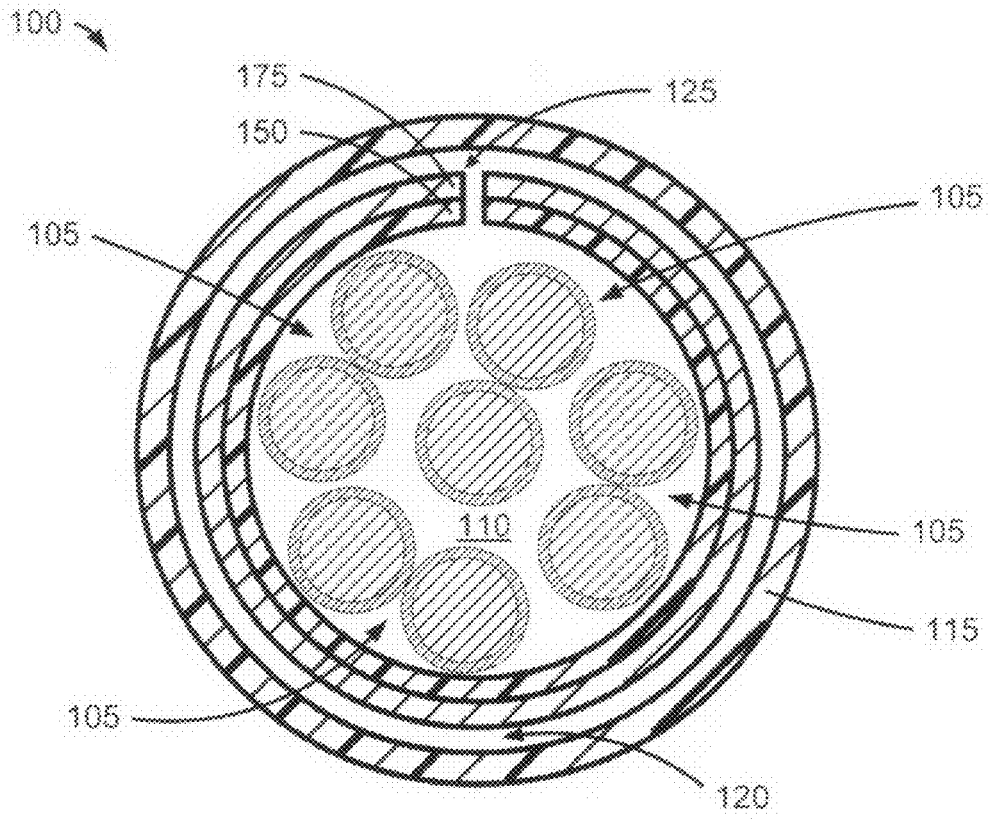
FIG. 1 is a cross sectional view of an exemplary communication cable that comprises a segmented shield in accordance with certain embodiments of the present invention.

Many aspects of the invention can be better understood with reference to the above drawings. The elements and features shown in the drawings are not to scale, emphasis instead being placed upon clearly illustrating the principles of exemplary embodiments of the present invention. Moreover, certain dimension may be exaggerated to help visually convey such principles. In the drawings, reference numerals designate like or corresponding, but not necessarily identical, elements throughout the several views.

DETAILED DESCRIPTION OF EXEMPLARY EMBODIMENTS

The present invention supports shielding a communication cable, wherein at least one break or discontinuity in a shielding material electrically isolates shielding at one end of the cable from shielding at the other end of the cable. As an alternative to forming a continuous or contiguous conductive path, the tape can be segmented or can comprise intermittently conductive patches or areas.

Cables comprising segmented tapes, and technology for making such cables, will now be described more fully hereinafter with reference to FIGS. 1-7, which describe representative embodiments of the present invention. In an exemplary embodiment, the segmented tape can be characterized as shielding tape or as tape with segments or patches of conductive material. FIG. 1 provides an end-on view of a cable comprising segmented tape. FIGS. 2A, 2B, 4, 5, and 6 illustrate representative segmented tapes. FIG. 2C depicts wrapping segmented tape around or over conductors. FIG. 3 offers a process for making cable with segmented shielding. FIGS. 7A and 7B (collectively Figure &) describe orientations of patches in cables.

The invention can be embodied in many different forms and should not be construed as limited to the embodiments set forth herein; rather, these embodiments are provided so that this disclosure will be thorough and complete, and will fully convey the scope of the invention to those having ordinary skill in the art. Furthermore, all "examples" or "exemplary embodiments" given herein are intended to be non-limiting, and among others supported by representations of the present invention.

Turning now to FIG. 1, this figure illustrates a cross sectional view of a communication cable 100 that comprises a segmented shield 125 according to certain exemplary embodiments of the present invention.

The core 110 of the cable 100 contains four pairs of conductors 105, four being an exemplary rather than limiting number. Each pair 105 can be a twisted pair that carries data, for example in a range of 1-10 Gbps or some other appropriate range. The pairs 105 can each have the same twist rate (twists-per-meter or twists-per-foot) or may be twisted at different rates.

The core 110 can be hollow as illustrated or alternatively can comprise a gelatinous, solid, or foam material, for example in the interstitial spaces between the individual conductors 105. In one exemplary embodiment, one or more members can separate each of the conductor pairs 105 from the other conductor pairs 105. For example, the core 110 can contain an extruded or pultruded separator that extends along the cable 110 and that provides a dedicated cavity or channel for each of the four conductor pairs 105. Viewed end-on or in cross section, the separator could have a cross-shaped geometry or an x-shaped geometry.

Such an internal separator can increase physical separation between each conductor pair 105 and can help maintain a random orientation of each pair 105 relative to the other pairs 105 when the cable 100 is field deployed.

A segmented tape 125 surrounds and shields the four conductor pairs 105. As discussed in further detail below, the segmented tape 125 comprises a dielectric substrate 150 with patches 175 of conductive material attached thereto. As illustrated, the segmented tape 125 extends longitudinally along the length of the cable 100, essentially running parallel with and wrapping over the conductors 105.

In an alternative embodiment, the segmented tape 125 can wind helically or spirally around the conductor pairs 105. More generally, the segmented tape 125 can circumferentially cover, house, encase, or enclose the conductor pairs 105. Thus, the segmented tape 125 can circumscribe the conductors 105, to extend around or over the conductors 105. Although FIG. 1 depicts the segmented tape 125 as partially circumscribing the conductors 105, that illustrated geometry is merely one example. In many situations, improved blockage of radiation will result from overlapping the segmented tape 125 around the conductors 105, so that the segmented tape fully circumscribes the conductors 105. Moreover, in certain embodiments, the side edges of the segmented tape 125 can essentially butt up to one another around the core 110 of the cable 100. Further, in certain embodiments, a significant gap can separate these edges, so that the segmented tape 125 does not fully circumscribe the core 110.

In one exemplary embodiment, one side edge of the segmented tape 125 is disposed over the other side edge of the tape 125. In other words, the edges can overlap one another, with one edge being slightly closer to the center of the core 110 than the other edge.

An outer jacket 115 of polymer seals the cable 110 from the environment and provides strength and structural support. The jacket 115 can be characterized as an outer sheath, a jacket, a casing, or a shell. A small annular spacing 120 may separate the jacket 115 from the segmented tape 125.

In one exemplary embodiment, the cable 100 or some other similarly noise mitigated cable can meet a transmission requirement for "10 G Base-T data corn cables." In one exemplary embodiment, the cable 100 or some other similarly noise mitigated cable can meet the requirements set forth for 10 Gbps transmission in the industry specification known as TIA 568-B.2-10 and/or the industry specification known as ISO 11801. Accordingly, the noise mitigation that the segmented tape 125 provides can help one or more twisted pairs of conductors 105 transmit data at 10 Gbps or faster without unduly experiencing bit errors or other transmission impairments. As discussed in further detail below, an automated and scalable process can fabricate the cable 100 using the segmented tape 125.

Figure 2A:
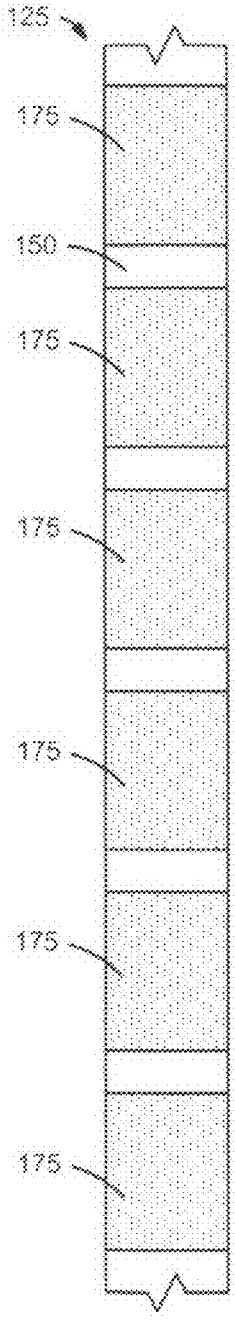
FIGS. 2A and 2B are, respectively, overhead and cross sectional views of an exemplary segmented tape that comprises a pattern of conductive patches attached to a dielectric film substrate in accordance with certain embodiments of the present invention.
Figure 2B:
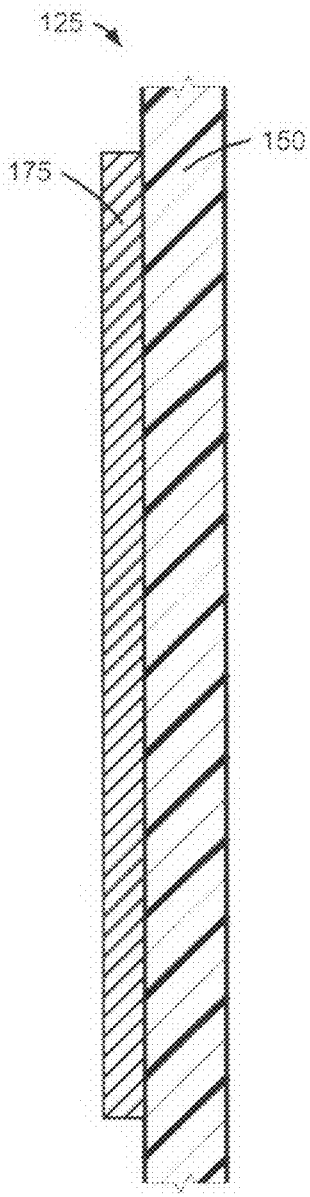
Figure 2C:
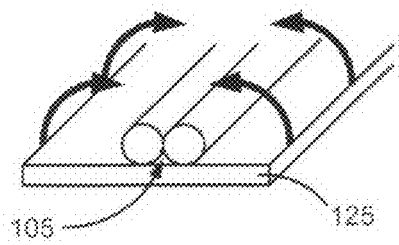
FIG. 2C is an illustration of an exemplary technique for wrapping a segmented tape lengthwise around a pair of conductors in accordance with certain embodiments of the present invention.
Figure 3A:
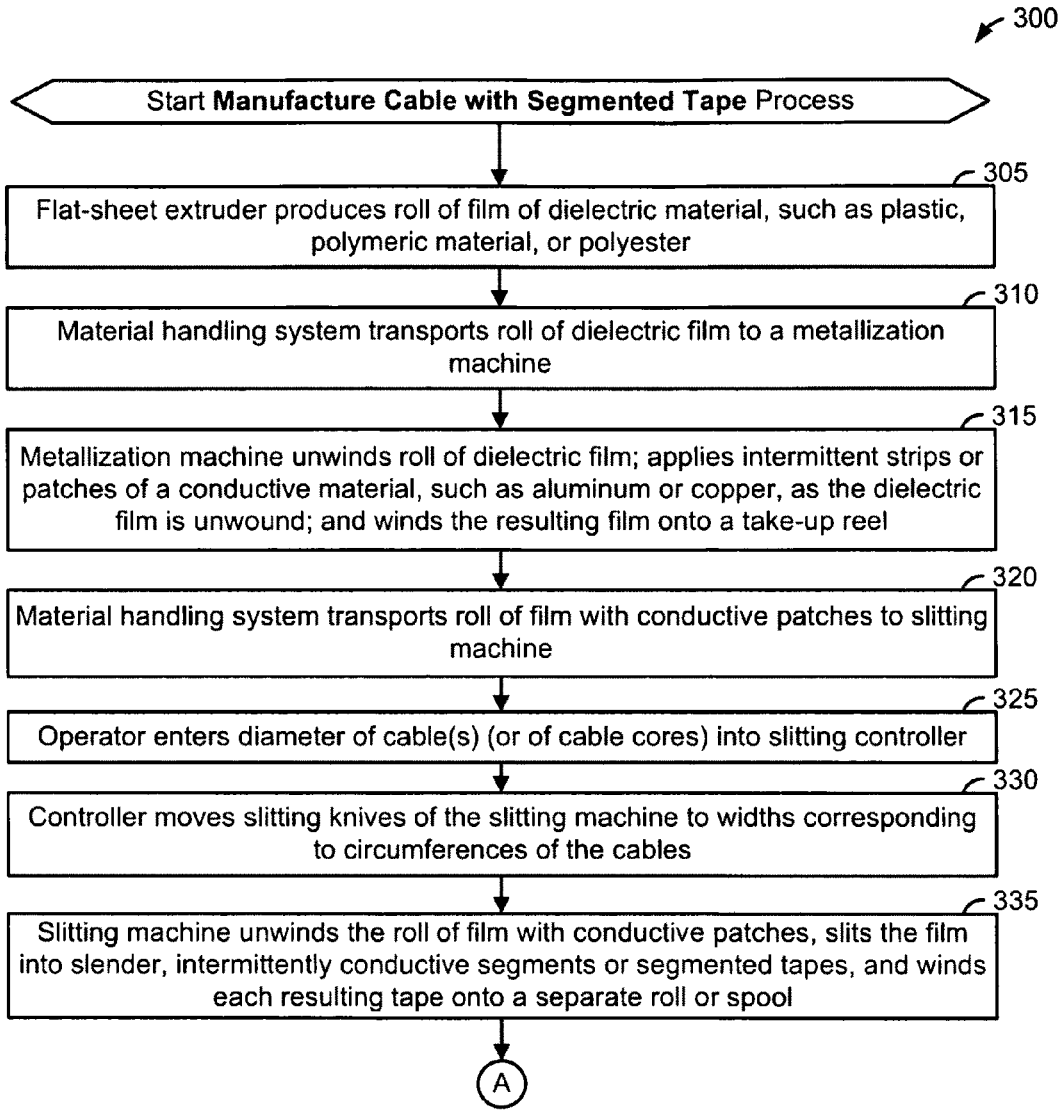
FIGS. 3A and 3B, collectively
Figure 3B:
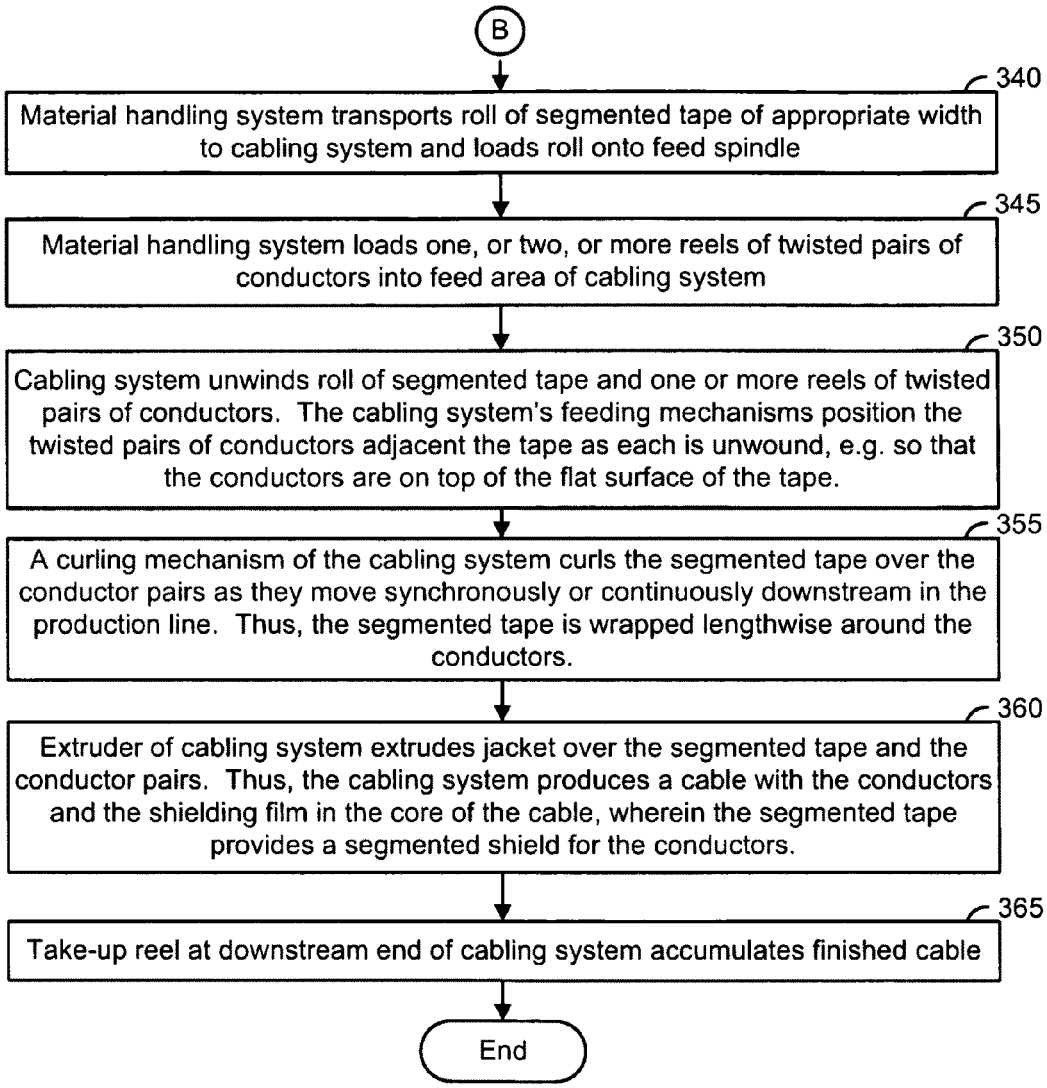

Turning now to FIGS. 2A and 2B, these figures respectively illustrate overhead and cross sectional views of a segmented tape 125 that comprises a pattern of conductive patches 175 attached to a dielectric substrate 150 according to certain exemplary embodiments of the present invention. That is, FIGS. 2A and 2B depict an exemplary embodiment of the segmented tape 125 shown in FIG. 1 and discussed above. More specifically, FIG. 1 illustrates a cross sectional view of the cable 100 wherein the cross section cuts through one of the conductive patches 175, perpendicular to the major axis of the segmented tape 125.

The segmented tape 125 comprises a dielectric substrate film 150 of flexible dielectric material that can be wound around and stored on a spool. That is, the illustrated section of segmented tape 125 can be part of a spool of segmented tape 125. The film can comprise a polyester, polypropylene, polyethylene, polyimide, or some other polymer or dielectric material that does not ordinarily conduct electricity. That is, the segmented tape 125 can comprise a thin strip of pliable material that has at least some capability for electrical insulation. In one exemplary embodiment, the pliable material can comprise a membrane or a deformable sheet. In one exemplary embodiment, the substrate is formed of the polyester material sold by E.I. DuPont de Nemours and Company under the registered trademark MYLAR.

The conductive patches 175 can comprise aluminum, copper, nickel, iron, or some metallic alloy or combination of materials that readily transmits electricity. The individual patches 175 can be separated from one another so that each patch 175 is electrically isolated from the other patches 175. That is, the respective physical separations between the patches 175 can impede the flow of electricity between adjacent patches 175.

The conductive patches 175 can span fully across the segmented tape 125, between the tape's long edges. As discussed in further detail below, the conductive patches 175 can be attached to the dielectric substrate 150 via gluing, bonding, adhesion, printing, painting, welding, coating, heated fusion, melting, or vapor deposition, to name a few examples.

In one exemplary embodiment, the conductive patches 175 can be over-coated with an electrically insulating film, such as a polyester coating (not shown in FIGS. 2A and 2B). In one exemplary embodiment, the conductive patches 175 are sandwiched between two dielectric films, the dielectric substrate 150 and another electrically insulating film (not shown in FIGS. 2A and 2B).

The segmented tape 125 can have a width that corresponds to the circumference of the core 110 of the cable 100. The width can be slightly smaller than, essentially equal to, or larger than the core circumference, depending on whether the longitudinal edges of the segmented tape 125 are to be separated, butted together, or overlapping, with respect to one another in the cable 100.

In one exemplary embodiment, the dielectric substrate 150 has a thickness of about 1-5 mils (thousandths of an inch) or about 25-125 microns. Each conductive patch 175 can comprise a coating of aluminum having a thickness of about 0.5 mils or about 13 microns. In many applications, signal performance benefits from a thickness that is greater than 2 mils, for example in a range of 2.0 - 2.5 mils, or 2.0 - 3.0 mils.

Each patch 175 can have a length of about 1.5 to 2 inches or about 4 to 5 centimeters. Other exemplary embodiments can have dimensions following any of these ranges, or some other values as may be useful. The dimensions can be selected to provide electromagnetic shielding over a specific band of electromagnetic frequencies or above or below a designated frequency threshold, for example.

In certain exemplary embodiments, each patch 175 has a length of about 2 meters, with the gaps between adjacent patches 175 about 1/16 of an inch. The resulting shield configuration provides a return loss spike in the operating band of the cable 100, which should be avoided by conventional thinking. However, the spike is unexpectedly suppressed, thereby providing an acceptable cable with segment and gap dimensions that offer manufacturing advantages. Thus, increasing the patch lengths benefits manufacturing while providing acceptable performance. The peak in return loss is surprisingly suppressed, and the cable 100 meets performance standards and network specifications.

In certain exemplary embodiments, each patch 175 covers a hole (not illustrated) in the dielectric substrate 150. In other words, the dielectric substrate 150 comprises holes or windows, with a patch 175 disposed over each hole or window. Typically, each patch 175 is slightly bigger than its associated window, so the patch 175 extends over the window edges. The windows eliminate a substantial portion of the flammable film substrate material, thereby achieving better burn characteristics, via producing less smoke, heat, and flame.

Turning now to FIG. 2C, this figure illustrates wrapping a segmented tape 125 lengthwise around a pair of conductors 105 according to certain exemplary embodiments of the present invention. Thus, FIG. 2C shows how the segmented tape 125 discussed above can be wrapped around or over one or more pairs of conductors 125 as an intermediate step in forming a cable 100 as depicted in FIG. 1 and discussed above. While FIG. 1 depicts four pairs of wrapped conductors 105, FIG. 2C illustrates wrapping a single pair 105 as an aid to visualizing an exemplary assembly technique.

As illustrated in FIG. 2C, the pair of conductors 105 is disposed adjacent the segmented tape 125. The conductors 105 extend essentially parallel with the major or longitudinal axis/dimension of the segmented tape 125. Thus, the conductors 105 can be viewed as being parallel to the surface or plane of the segmented tape 125. Alternatively, the conductors 105 can be viewed as being over or under the segmented tape 125 or being situated along the center axis of the segmented tape 125. Moreover, the conductors 105 can be viewed as being essentially parallel to one or both edges of the segmented tape 125.

In most applications the conductors 105, which are typically individually insulated, will be twisted together to form a twisted pair. And, the segmented tape 125 will wrap around the twisted pair as discussed below. FIG. 7A, discussed below, illustrates such an embodiment. In certain embodiments, multiple twisted pairs of conductors 105 will be twisted, bunched, or cabled together, with the segmented tape 125 providing a circumferential covering.

The long edges of the segmented tape 125 are brought up over the conductors 105, thereby encasing the conductors 105 or wrapping the segmented tape 125 around or over the conductors 105. In an exemplary embodiment, the motion can be characterized as folding or curling the segmented tape 125 over the conductors 105. As discussed above, the long edges of the segmented tape 125 can overlap one another following the illustrated motion.

In certain exemplary embodiments, the segmented tape 125 is wrapped around the conductors 105 without substantially spiraling the segmented tape 125 around or about the conductors. Alternatively, the segmented tape 125 can be wrapped so as to spiral around the conductors 105.

In one exemplary embodiment, the conductive patches 175 face inward, towards the conductors 105. In another exemplary embodiment, the conductive patches 175 face away from the conductors 105, towards the exterior of the cable 100.

In one exemplary embodiment, the segmented tape 125 and the conductors 105 are continuously fed from reels, bins, containers, or other bulk storage facilities into a narrowing chute or a funnel that curls the segmented tape 125 over the conductors 105.

In one exemplary embodiment, FIG. 2C describes operations in a zone of a cabling machine, wherein segmented tape 125 fed from one reel (not illustrated) is brought into contact with conductors 105 feeding off of another reel. That is, the segmented tape 125 and the pair of conductors 105 can synchronously and/or continuously feed into a chute or a mechanism that brings the segmented tape 125 and the conductors 105 together and that curls the segmented tape 125 lengthwise around the conductors 105. So disposed, the segmented tape 125 encircles or encases the conductors 105 in discontinuous, conductive patches.

Downstream from this mechanism (or as a component of this mechanism), a nozzle or outlet port can extrude a polymeric jacket, skin, casing, or sheath 115 over the segmented tape, thus providing the basic architecture depicted in FIG. 1 and discussed above.

Turning now to FIG. 3, this figure is a flowchart depicting a process 300 for manufacturing cable 100 according to certain exemplary embodiments of the present invention. Process 300 can produce the cable 100 illustrated in FIG. 1 using the segmented tape 125 and the conductors 105 as base materials.

At Step 305 an extruder produces a film of dielectric material, such as polyester, which is wound onto a roll or a reel. At this stage, the film can be much wider than the circumference of any particular cable in which it may ultimately be used and might be one to three meters across, for example. As discussed in further detail below, the extruded film will be processed to provide the dielectric substrate 150 discussed above.

At Step 310, a material handling system transports the roll to a metallization machine or to a metallization station. The material handling system can be manual, for example based on one or more human operated forklifts or may alternatively be automated, thereby requiring minimal, little, or essentially no human intervention during routine operation. The material handling may also be tandemized with a film producing station. Material handing can also comprise transporting materials between production facilities or between vendors or independent companies, for example via a supplier relationship.

At Step 315, the metallization machine unwinds the roll of dielectric film and applies a pattern of conductive patches 175 to the film. The patches 175 typically comprise strips that extend across the roll, perpendicular to the flow of the film off of the roll. The patches 175 are typically formed while the sheet of film is moving from a payoff roll (or reel) to a take-up roll (or reel). As discussed in further detail below, the resulting material will be further processed to provide multiple of the segmented tapes 125 discussed above.

In certain exemplary embodiments, the metallization machine can apply the conductive patches 175 to the dielectric substrate 150 by coating the moving sheet of dielectric film with ink or paint comprising metal. In one exemplary embodiment, the metallization machine can laminate segments of metallic film onto the dielectric film. Heat, pressure, radiation, adhesive, or a combination thereof can laminate the metallic film to the dielectric film.

In certain exemplary embodiments, flame retardant and/or smoke suppressant materials are incorporated into the segmented tape 125. A PVC color film or emulsion can be coated on patches 175 that comprise aluminum, for example. A flame retardant adhesive can be used to bond the patches 175 to the dielectric substrate 150.

In certain exemplary embodiments, the conductive patches 175 are attached to the dielectric substrate 150 with mechanical fasteners. Replacing an adhesive fastening system with a mechanical system can improve a cable's burn characteristics—producing less smoke, less flame, and less heat.

In certain exemplary embodiments each fastener comprises a hole extending through the dielectric substrate 150 and a conductive patch 175. The edges or periphery of the hole curl under to capture the two materials, in a "rivet effect" or a "peening effect." Each patch 175 can be attached to the dielectric substrate 150 with an array of such holes, each of which may be 0.25 to 2.0 millimeters in diameter, for example. An array of needles or pins can be thrust through each conductive patch 175 and the adjacent dielectric substrate 150, for example.

In certain exemplary embodiments, each fastener can comprise a staple, rivet, or pin that goes through a conductive patch 175 and the associated dielectric substrate 150. Such a fastener can be bent or flattened on opposite sides of the patch-substrate assembly so as to embrace the patch 175 and the dielectric substrate 150, thereby capturing the patch 175.

In certain exemplary embodiments, the fastener comprises an embossing. In this case, each patch 175 is pressed onto the dielectric substrate 150 with a roller that creates small indentations or corrugations. The indentations bind the two layers together, similar to the manner in which a two-ply napkin or tissue paper is held together.

In one exemplary embodiment, the metallization machine cuts a feed of pressure-sensitive metallic tape into appropriately sized segments. Each cut segment is placed onto the moving dielectric film and is bonded thereto with pressure, thus forming a pattern of conductive strips across the dielectric film.

In one exemplary embodiment, the metallization machine creates conductive areas on the dielectric film using vacuum deposition, electrostatic printing, or some other metallization process known in the art.

As discussed in further detail below with reference to FIGS. 4-7, in certain exemplary embodiments, the metallization machine applies conductive patches 175 to both sides of the film, so that conductive patches 175 on one film side cover un-patched areas on the other film side.

At Step 320, the material handling system transports the roll of film, which comprises a pattern of conductive areas or patches at this stage, to a slitting machine. At Step 325, an operator, or a supervisory computer-based controller, of the slitting machine enters a diameter of the core 110 of the cable 100 that is to be manufactured.

At Step 330, the slitting machine responds to the entry and moves its slitting blades or knives to a width corresponding to the circumference of the core 110 of the cable 100. As discussed above, the slitting width can be slightly less than the circumference, thus producing a gap around the conductor(s) or slightly larger than the circumference to facilitate overlapping the edges of the segmented tape 125 in the cable 100.

At Step 335, the slitting machine unwinds the roll and passes the sheet through the slitting blades, thereby slitting the wide sheet into narrow strips, ribbons, or tapes 125 that have widths corresponding to the circumferences of one or more cables 100. The slitting machine winds each tape 125 unto a separate roll, reel, or spool, thereby producing the segmented tape 125 as a roll or in some other bulk form.

While the illustrated embodiment of Process 300 creates conductive patches on a wide piece of film and then slits the resulting material into individual segmented tapes 125, that sequence is merely one possibility. Alternatively, a wide roll of dielectric film can be slit into strips of appropriate width that are wound onto individual rolls. A metallization machine can then apply conductive patches 175 to each narrow-width roll, thereby producing the segmented tape 125. Moreover, a cable manufacturer might purchase pre-sized rolls of the dielectric substrate 150 and then apply the conductive patches 175 thereto to create corresponding rolls of the segmented tape 125.

At Step 340, the material handling system transports the roll of sized segmented tape 125, which comprises the conductive patches 175 or some form of isolated segments of electrically conductive material, to a cabling system. The material handling system loads the roll of the segmented tape 125 into the cabling system's feed area, typically on a designated spindle. The feed area is typically a facility where the cabling machine receives bulk feedstock materials, such as segmented tape 125 and conductors 105.

At Step 345, the material handling system loads rolls, reels, or spools of conductive wires 105 onto designated spindles at the cabling system's feed area. To produce the cable 100 depicted in FIG. 1 as discussed above, the cabling system would typically use four reels, each holding one of the four pairs of conductors 105.

At Step 350, the cabling system unwinds the roll of the segmented tape 125 and, in a coordinated or synchronous fashion, unwinds the pairs of conductors 105. Thus, the segmented tape 125 and the conductors 105 feed together as they move through the cabling system.

A tapered feed chute or a funneling device places the conductors 105 adjacent the segmented tape 125, for example as illustrated in FIG. 2C and discussed above. The cabling system typically performs this material placement on the moving conductors 105 and segmented tape 125, without necessarily requiring either the conductors 105 or the segmented tape 125 to stop. In other words, tape-to-conductor alignment occurs on a moving steam of materials.

At Step 355, a curling mechanism wraps the segmented tape 125 around the conductors 105, typically as shown in FIG. 2C and as discussed above, thereby forming the core 110 of the cable 100. The curling mechanism can comprise a tapered chute, a narrowing or curved channel, a horn, or a contoured surface that deforms the segmented tape 125 over the conductors 105, typically so that the long edges of the segmented tape 125 overlap one another.

As will be discussed in further detail below with reference to FIG. 7, the conductive patches can be oriented so as to spiral in an opposite direction to pair and/or core twist of the cable 100.

At Step 360, an extruder of the cabling system extrudes the polymer jacket 115 over the segmented tape 125 (and the conductors 105 wrapped therein), thereby forming the cable 100. Extrusion typically occurs downstream from the curling mechanism or in close proximity thereof. Accordingly, the jacket 115 typically forms as the segmented tape 125, the conductors 105, and the core 110 move continuously downstream through the cabling system.

At Step 365, a take-up reel at the downstream side of the cabling system winds up the finished cable 100 in preparation for field deployment. Following Step 365, Process 300 ends and the cable 100 is completed. Accordingly, Process 300 provides an exemplary method for fabricating a cable comprising an electrically discontinuous shield that protects against electromagnetic interference and that supports high-speed communication.

Turning now to FIG. 4, this figure illustrates segmented tapes 400, 425, 475 comprising conductive patches 175A, 175B disposed on opposite sides of a dielectric substrate 150 according to certain exemplary embodiments of the present invention. The tapes 400, 425, and 475 are alternative embodiments to the segmented tape 125 discussed above with reference to FIGS. 1-3.

Figure 4A:
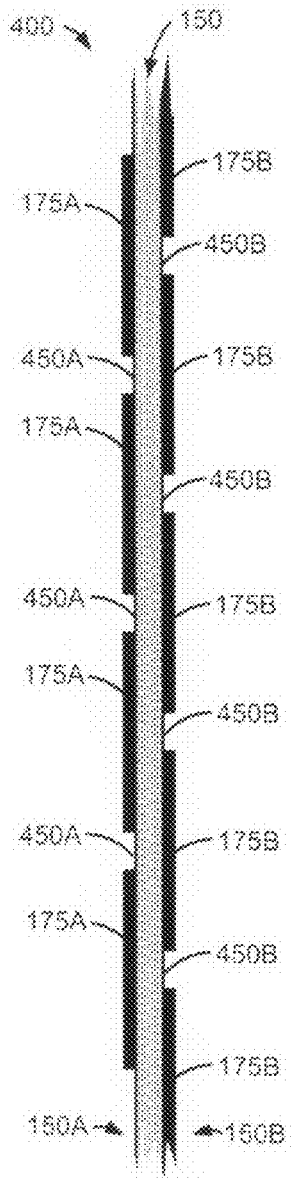
FIGS. 4A, 4B, and 4C, collectively

The tape 400 of FIG. 4A comprises conductive patches 175A attached to the tape side 150A with isolating spaces 450A between adjacent conductive patches 175A. In other words, the conductive patches 175A are separated from one another to avoid patch-to-patch electrical contact. Additional conductive patches 175B are disposed on the tape side 150B, and isolating spaces 450B likewise provide electrical isolation between and/or among those conductive patches 175B.

The conductive patches 175A on tape side 150A cover the isolating spaces 450B of tape side 150B. Likewise, the conductive patches 175B on tape side 150B cover the isolating spaces 450A of tape side 150A. In other words, the conductive patches 175A, 175B on one tape side 150A, 150B block, are in front of, are behind, or are disposed over the isolating spaces 450A, 450B on the opposite tape side 150A, 150B.

When the tape 400 is deployed in the cable 100 with overlapping or abutted tape edges, for example as discussed above with reference to FIG. 1, the conductive patches 175A and 175B cooperate to fully circumscribe the pairs 105. That is, the pairs 105 are circumferentially covered and encased by the conductive areas of the conductive patches 175A and 175B. Such coverage blocks incoming and/or outgoing radiation from passing through the isolating spaces 450A and 450B.

Figure 4B:
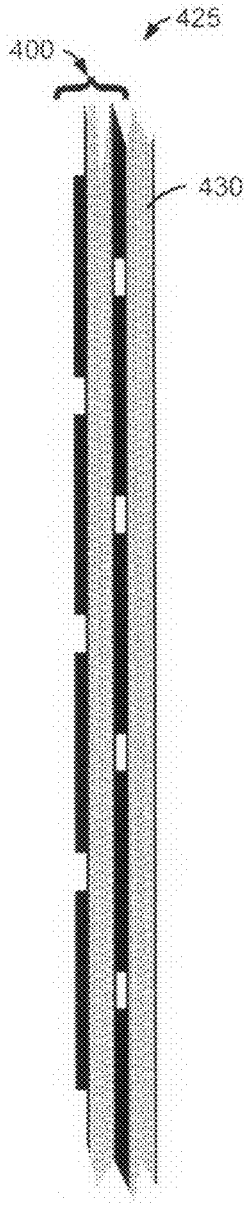

In the embodiment of FIG. 4B, a dielectric film 430 covers the tape side 150B of the tape 400. The resulting dielectric coating provides an electrically insulating barrier to avoid contact of the conductive patches 175B with one another or with the conductive patches 175A when the tape 425 is wrapped around the pairs 105.

Typically, the tape 425 is disposed in the cable 100 such that the exposed conductive patches 175A face away from the pairs 105, while the dielectric film 430 and the conductive patches 175B face towards the pairs 105. With this orientation, the conductive patches 175A can have a thickness of about 0.1 to 1.0 mils of aluminum, and the conductive patches 175B can have a thickness of about 1.0 to 1.6 mils of aluminum. In many applications, a thickness of at least 2 mils provides beneficial electrical performance. In other words, increasing shielding thickness to about 2 mils provides improved electrical performance. For example, the thickness can be in a range of 2-2.5 mils or 2-3 mils. Such geometry, dimension, and materials can provide shielding that achieves beneficial high-frequency isolation.

In an exemplary embodiment, the conductive patches 175A and the conductive patches 175B have substantially different thicknesses. In an exemplary embodiment, the conductive patches 175A and the conductive patches 175B have substantially different thicknesses and are formed of essentially the same conductive material.

In one exemplary embodiment, the conductive patches 175A are thicker than a skin depth associated with signals communicated over the cable 100. In one exemplary embodiment, the conductive patches 175B are thicker than a skin depth associated with signals communicated over the cable 100. In one exemplary embodiment, each of the conductive patches 175A and the conductive patches 175B is thicker than a skin depth associated with signals communicated over the cable 100.

The term "skin depth," as used herein, generally refers to the depth below a conductive surface at which an induced current falls to 1/e (about 37 percent) of the value at the conductive surface, wherein the induced current results from propagating communication signals in an adjacent wire or similar conductor. This term usage is intended to be consistent with that of one of ordinary skill in the art having benefit of this disclosure.

In certain exemplary embodiments, performance benefit results from making the conductive patches 175A and or the conductive patches 175B with a thickness of about three or more times a skin depth. In certain exemplary embodiments, performance benefit results from making the conductive patches 175A and or the conductive patches 175B with a thickness of at least two times a skin depth.

In an exemplary embodiment, the cable 100 carries signals comprising a frequency component of 100 MHz, and the skin depth is computed or otherwise determined based on such a frequency.

Figure 4C:
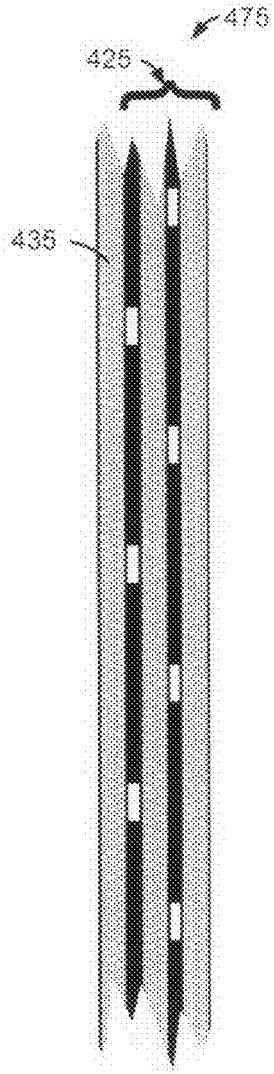

In the embodiment of FIG. 4C, another dielectric film 435 covers the tape side 150A of the tape 500. Thus, the dielectric film 435 insulates the conductive patches 175A from contact with one another (or some other electrical conductor) when the tape 475 is deployed in the cable 100 as discussed above.

Turning now to FIG. 5, this figure illustrates, from different viewing perspectives, a segmented tape 500 comprising conductive patches 175A, 175B disposed on opposite sides 150A, 150B of a dielectric substrate/film 150 according to certain exemplary embodiments of the present invention.

Figure 5A:
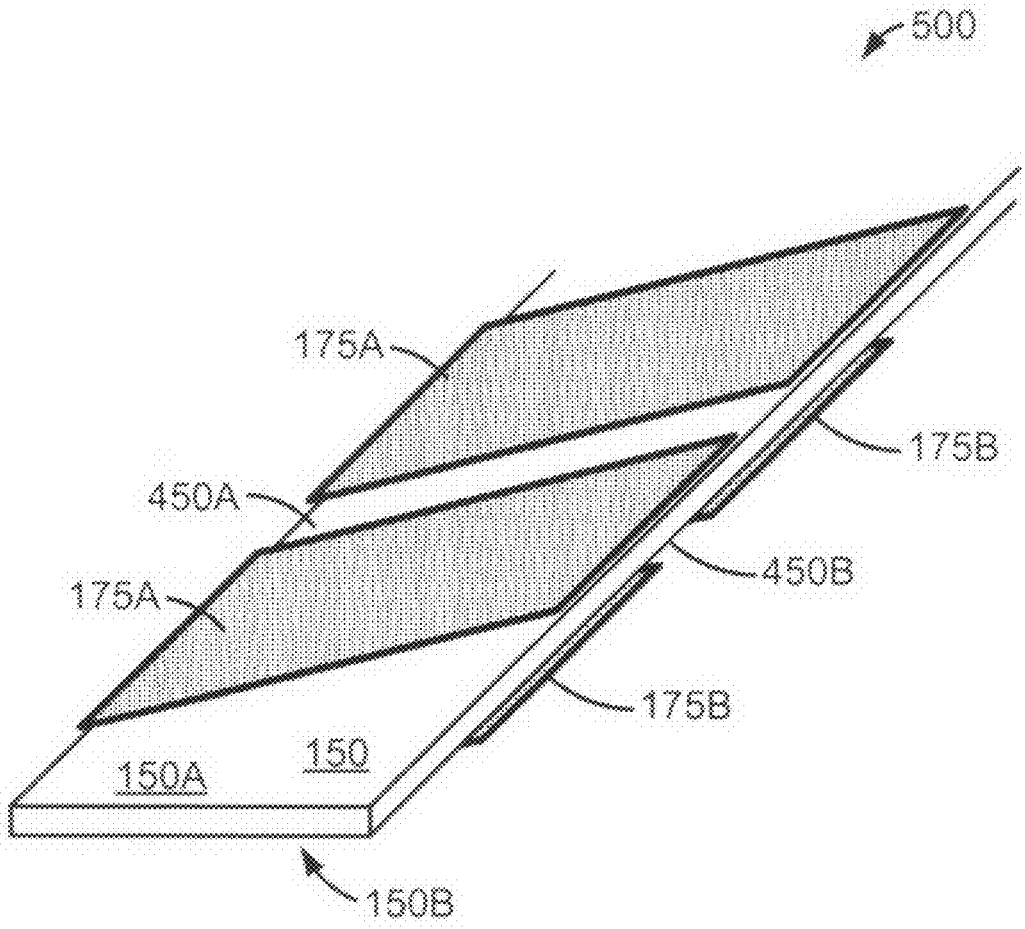
FIGS. 5A, 5B, 5C, and 5D, collectively
Figure 5B:
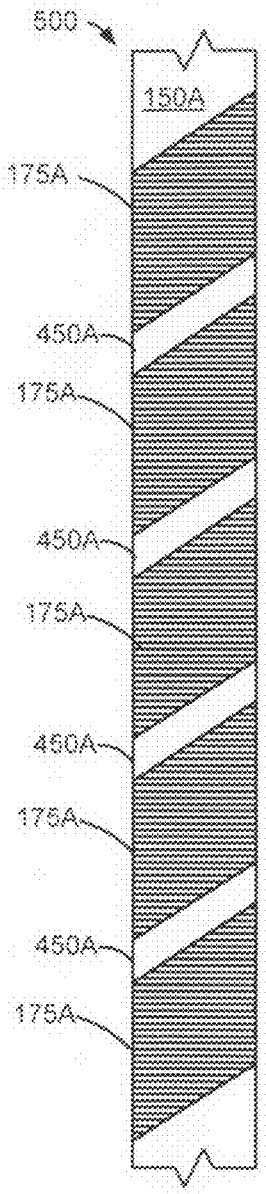
Figure 5C:
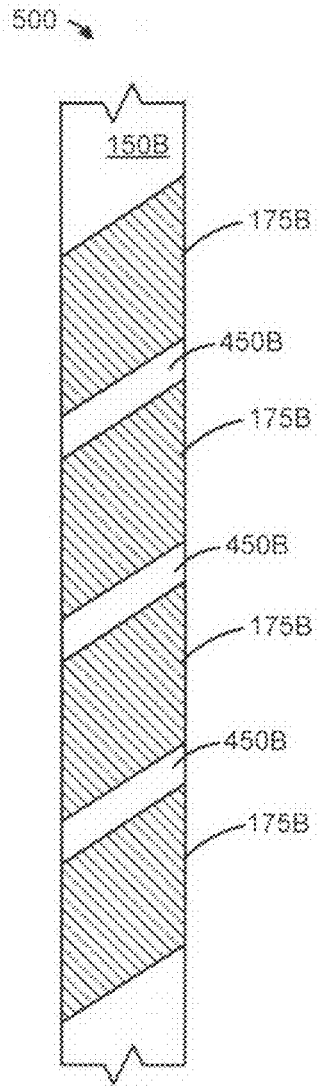
Figure 5D:
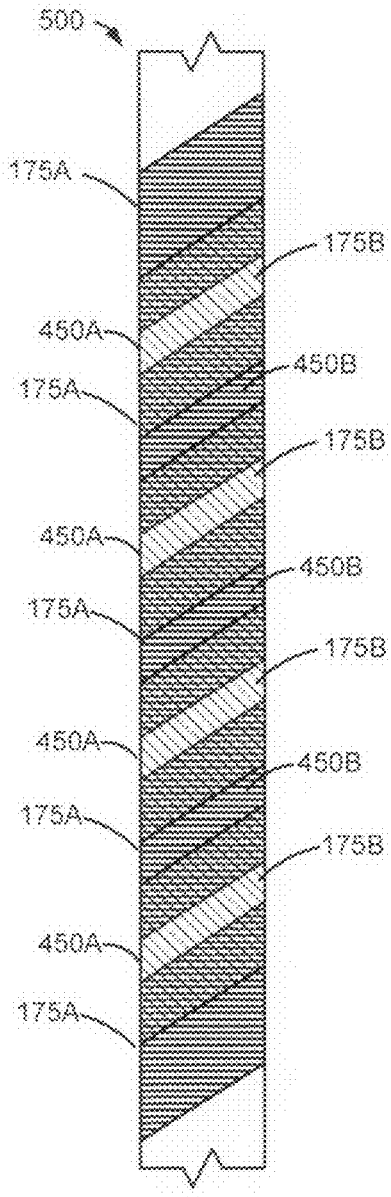

FIG. 5A illustrates a perspective view of the tape 500. FIG. 5B illustrates a view of the tape side 150A of the tape 500. FIG. 5C illustrates a view of the tape side 150B of the tape 500. FIG. 5D illustrates a view of the tape 500 in which both tape sides 150A and 150B are visible, as if the tape 500 was partially transparent. (The dielectric film 435 may be opaque, colored or transparent, while the conductive patches 175A, 175B may be visibly metallic, nonmetallic, opaque, or partially transparent.) Thus, FIG. 5D depicts the tape 500 as transparent to illustrate an exemplary embodiment in which the conductive patches 175A cover the isolating spaces 450B, and the conductive patches 175B cover the isolating spaces 450A.

In the exemplary embodiment that FIG. 5 illustrates, each of the conductive patches 175A and 175B has a geometric form of a parallelogram with two acute angles 600 (see FIG. 6) that are opposite one another and two obtuse angles 610 (see FIG. 6) that are opposite one another. The conductive patches 175A and the conductive patches 175B are oriented in the same longitudinal direction with respect to each other. Thus, along one edge of the tape 500, the acute corners (see FIG. 6 under reference number 600) of the patches 175A and the patches 175B point in the same tape direction.

In certain exemplary embodiments, the geometric form of the patches 175A is substantially different than the geometric form of the patches 175B. As compared to the patches 175A, the patches 175B can have a different number of sides, different side lengths, different angles, different surface area, etc.

In certain exemplary embodiments, at least one of the patches 175A and 175B is a square, a rectangle, or a parallelogram. In certain exemplary embodiments, at least one of the patches 175A and 175B comprises a geometric form having two acute angles.

In certain exemplary embodiments, each of the patches 175A is bonded to the tape side 150A with an adhesive that is applied not only under the patches 175A, but also on an area of the tape side 150A that is not covered with a patch 175A. Thus, the adhesive can be exposed in the isolating spaces 450A and/or in a strip running along the tape 500. For example, the patches 175A can be narrower than the tape side 150A such that an adhesive area extends along an edge of the tape 500, next to the patches 175A. Stated another way, the dielectric substrate 150/film provides an adhesive-coated substrate that is wider than the patches 175A to provide an adhesive strip running lengthwise along the tape 500. When the tape 500 is wrapped around a cable core or a group of twisted pairs, the adhesive binds the assembly closed. When curled around the cable core, the adhesive strip overlaps and adheres to the tape side 150A, like an adhesive-coated flap of an envelope that seals the envelope shut. A cable core formed in this manner is robust and can be transported between manufacturing operations for application of the polymer jacket 115.

Figure 6:
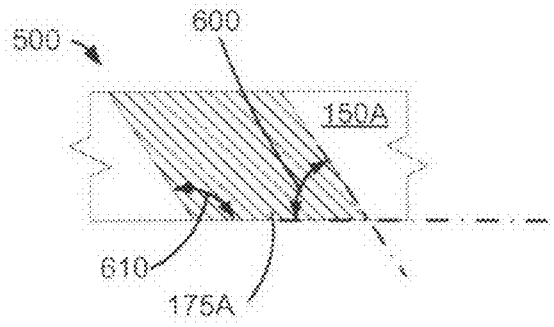
FIG. 6 is an illustration of an exemplary geometry for a conductive patch of a segmented tape in accordance with certain embodiments of the present invention.
Figure 7A:
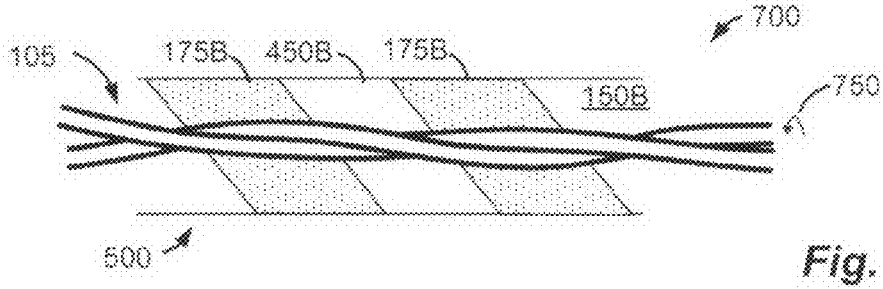
FIG. 7A is an illustration of an exemplary orientation for conductive patches of a segmented tape with respect to a twisted pair of conductors in accordance with certain embodiments of the present invention.
Figure 7B:
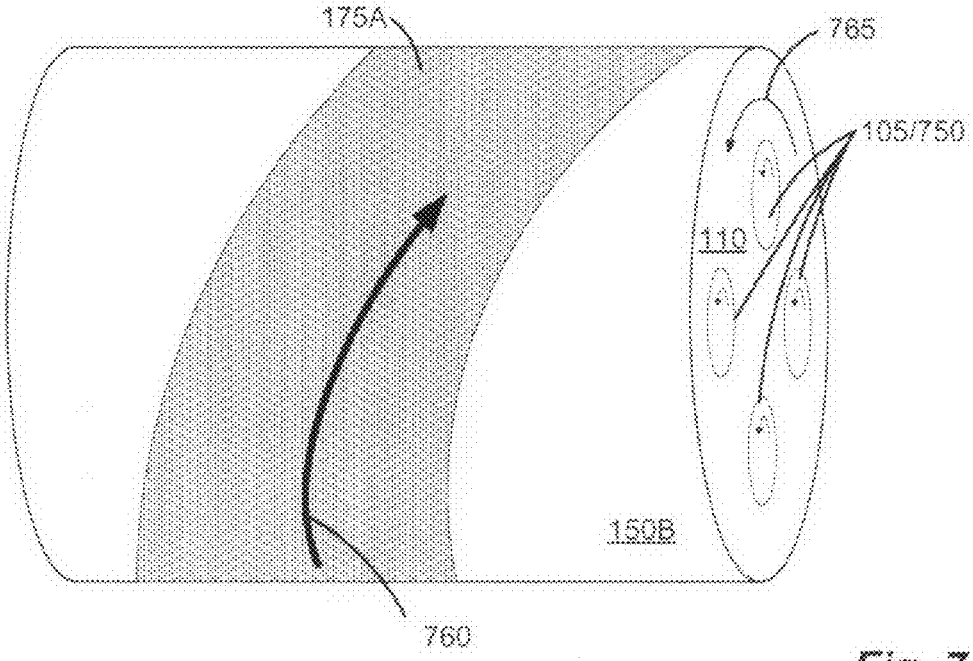
FIG. 7B is an illustration of a core of a communication cable comprising conductive patches disposed in an exemplary geometry with respect to a twist direction of twisted pairs and to a twist direction of the cable core in accordance with certain embodiments of the present invention.

Turning now to FIG. 6, this figure illustrates a geometry for a conductive patch 175A of a segmented tape 500 according to certain exemplary embodiments of the present invention. As illustrated in FIG. 6, the acute angle 600 facilitates manufacturing, helps the patches 175A and 175B cover the opposing isolating spaces 450A and 450B, and enhances patch-to-substrate adhesion.

The acute angle 600 results in the isolating spaces 450A and 450B being oriented at a non-perpendicular angle with respect to the pairs 105 and the longitudinal axis of the cable 105. If any manufacturing issue results in part of the isolating spaces 450A and 450B not being completely covered (by a conductive patch 175A, 175B on the opposite tape side 150A, 150B), such an open area will likewise be oriented at a non-perpendicular angle with respect to the pairs 105. Such an opening will therefore spiral about the pairs 105, rather than circumscribing a single longitudinal location of the cable 105. Such a spiraling opening is believed to have a lesser impact on shielding than would an opening circumscribing a single longitudinal location. In other words, an inadvertent opening that spirals would allow less unwanted transmission of electromagnetic interference that a non-spiraling opening.

In certain exemplary embodiments, benefit is achieved when the acute angle 600 is about 45 degrees or less. In certain exemplary embodiments, benefit is achieved when the acute angle 600 is about 35 degrees or less. In certain exemplary embodiments, benefit is achieved when the acute angle 600 is about 30 degrees or less. In certain exemplary embodiments, benefit is achieved when the acute angle 600 is about 25 degrees or less. In certain exemplary embodiments, benefit is achieved when the acute angle 600 is about 20 degrees or less. In certain exemplary embodiments, benefit is achieved when the acute angle 600 is about 15 degrees or less. In certain exemplary embodiments, benefit is achieved when the acute angle 600 is between about 12 and 40 degrees. In certain exemplary embodiments, the acute angle 600 is in a range between any two of the degree values provided in this paragraph.

Turning now to FIG. 7A, this figure illustrates an orientation for conductive patches 175B of a segmented tape 500 with respect to a twisted pair 105 of conductors according to certain exemplary embodiments of the present invention. The pair 105 has a particular twist direction 750 (clockwise or counter clockwise) known as a twist lay. That is, the pair 105 may have a "left hand lay" or a "right hand lay."

When the tape 500 is wrapped around the pair 105 as illustrated in FIG. 2C and discussed above, the conductive patches 175B spiral about the pair in a direction that is opposite the twist lay. That is, if the pair 105 is twisted in a counterclockwise direction, the conductive patches 175B (as well as the conductive patches 175A and the isolating spaces 450A and 450B) spiral in a clockwise direction. If the pair 105 is twisted in a clockwise direction, the conductive patches 175B (as well as the conductive patches 175A and the isolating spaces 450A and 450B) spiral in a counterclockwise direction.

With this rotational configuration, the edges of the conductive patches 175B that extend across the tape 500 tend to be more perpendicular to each of the individually insulated conductors of the pair 105, than would result from the opposite configuration. In most exemplary embodiments and applications, this configuration can provide an enhanced level of shielding performance.

Turning now to FIG. 7B, this figure illustrates a core 110 of a communication cable 100 comprising conductive patches 175A disposed in a particular geometry with respect to a twist direction 750 of twisted pairs 105 and to a twist direction 765 of the cable core 110 according to certain exemplary embodiments of the present invention.

As discussed above with reference to FIG. 7A, the conductive patches 175A and 175B have a spiral direction 760 that is opposite the twist direction 750 of the pairs. In the illustrated exemplary embodiment, the core 110 of the cable 100 is also twisted. That is, the four twisted pairs 105 are collectively twisted about a longitudinal axis of the cable 100 in a common direction 765. The twist direction 765 of the core 110 is opposite the spiral direction of the conductive patches 175A. That is, if the core 110 is twisted in a clockwise direction, then the conductive patches 175A spiral about the core 110 in a counterclockwise direction. If the core 110 is twisted in a counterclockwise direction, then the conductive patches 175A spiral about the core 110 in a clockwise direction. Thus, cable lay opposes the direction of the patch spiral. In most exemplary embodiments and applications, this configuration can provide an enhanced level of shielding performance.

From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the exemplary embodiments, equivalents of the elements shown therein will suggest themselves to those skilled in the art, and ways of constructing other embodiments of the present invention will suggest themselves to practitioners of the art. Therefore, the scope of the present invention is to be limited only by the claims that follow.

What is claimed is:

1. A communication cable comprising:

a pair of individually insulated electrical conductors comprising a twist lay; and a tape wrapped around the pair of individually insulated electrically conductors, the tape comprising:

a substrate comprising dielectric material;

first electrically conductive patches that are electrically isolated from one another, that are longitudinally separated from one another, and that are attached to a first side of the substrate; and second electrically conductive patches that are electrically isolated from one another, that are longitudinally separated from one another, and that are attached to a second side of the substrate, wherein each of the first and second patches comprises a respective edge spiraling about the pair in a common direction opposite the twist lay.

2. The communication cable of claim 1, wherein each of the first electrically conductive patches is thicker than each of the second electrically conductive patches and is substantially thicker than a skin depth for a frequency of a signal that the communication cable is operative to carry.

3. The communication cable of claim 1, wherein the pair of individually insulated electrical conductors is twisted in a counterclockwise direction and wherein the edges spiral in a clockwise direction.

4. The communication cable of claim 1, wherein each of the first electrically conductive patches is substantially thicker than each of the second electrically conductive patches, and wherein the first side faces the pair of individually insulated electrical conductors.

5. The communication cable of claim 4, wherein each of the first electrically conductive patches is thicker than a skin depth for a frequency of a signal that the communication cable is operative to carry.

6. The communication cable of claim 5, wherein one of the second electrically conductive patches on the second side of the tape covers a separation between two of the first electrically conductive patches on the first side of the tape.

7. The communication cable of claim 6, wherein one of the first electrically conductive patches on the first side of the tape covers a separation between two of the second electrically conductive patches on the second side of the tape.

8. The communication cable of claim 1, wherein the first electrically conductive patches in combination with the second electrically conductive patches circumferentially cover the pair of individually insulated electrical conductors.

9. The communication cable of claim 1, wherein the communication cable comprises a core comprising the pair of individually insulated electrical conductors and at least one additional conductor, wherein the core is twisted in a same rotational direction as the twist lay.

10. The communication cable of claim 1, wherein the communication cable comprises a core comprising the pair of individually insulated electrical conductors and at least one additional conductor.

11. An apparatus for isolating an electrical conductor, comprising:

a strip of dielectric film comprising a first edge, a second edge, a first side between the first edge and the second edge, and a second side opposite the first side;

a first plurality of conductive film segments, each attached to the first side of the strip of dielectric film, wherein first isolation regions separate the first plurality of conductive film segments from one another; and a second plurality of conductive film segments, each attached to the second side of the strip of dielectric film, wherein second isolation regions separate the second plurality of conductive film segments from one another, wherein the first plurality of film segments overlap the second isolation regions, wherein each of the first plurality of conductive film segments comprises a respective thickness within a first thickness range, wherein each of the second plurality of conductive film segments comprises a respective thickness within a second thickness range, and wherein the first thickness range is outside the second thickness range.

12. The apparatus of claim 11, wherein the second plurality of conductive film segments overlap the first isolation regions.

13. The apparatus of claim 11, wherein the first plurality of conductive film segments cover the second isolation regions, and wherein the second plurality of conductive film segments cover the first isolation regions.

14. The apparatus of claim 11, wherein each of the first plurality of conductive film segments comprises an edge disposed at a substantially acute angle with respect to the first edge.

15. The apparatus of claim 11, wherein each of the first plurality of conductive film segments comprises an edge disposed at an acute angle with respect to the first edge, and wherein each of the second plurality of conductive film segments comprises another edge disposed at another acute angle with respect to the first edge.

16. The apparatus of claim 11, wherein each of the first plurality of conductive film segments comprises an edge forming an included angle with the first edge, wherein the included angle is between about five degrees and about 45 degrees.

17. The apparatus of claim 11, wherein each of the first plurality of conductive film segments comprises an edge forming an angle of less than about 45 degrees with the first edge, and wherein each of the second plurality of conductive film segments comprises another edge forming another angle of less than about 45 degrees with the first edge.

18. The apparatus of claim 11, wherein the first plurality of conductive film segments or the second plurality of conductive film segments comprises rectangular conductive film segments.

19. The apparatus of claim 11, wherein at least one conductive film segment in the first plurality of conductive film segments or the second plurality of conductive film segments comprises a parallelogram having two acute angles that are opposite one another.

20. The apparatus of claim 11, wherein each of the first plurality of conductive film segments has a substantially different geometric outline than each of the second plurality of conductive film segments.

21. An apparatus for isolating an electrical conductor, comprising:

a strip of dielectric film comprising a first edge, a second edge, a first side between the first edge and the second edge, and a second side opposite the first side;

a first plurality of conductive film segments, each attached to the first side of the strip of dielectric film, wherein first isolation regions separate the first plurality of conductive film segments from one another; and a second plurality of conductive film segments, each attached to the second side of the strip of dielectric film, wherein second isolation regions separate the second plurality of conductive film segments from one another, wherein the first plurality of film segments overlap the second isolation regions, wherein the first plurality of conductive film segments are electrically isolated from the second plurality of conductive film segments, wherein the first side of the strip of dielectric film faces the electrical conductor, wherein the each of the first plurality of conductive film segment is thicker than a skin depth for a frequency of a signal that the electrical conductor is operative to carry, and wherein each of the first plurality of conductive film segments is thicker than each of the second plurality of conductive film segments.

22. A communication cable comprising:

a core that comprises a plurality of pairs of individually insulated electrical conductors, wherein each pair is individually twisted in a rotational direction, and wherein the core is twisted in the rotational direction; and a tape, curled around the core, that comprises:

a first edge extending substantially parallel to the communication cable;

a second edge extending substantially parallel to the communication cable;

a first side;

a second side;

a plurality of electrically conductive patches that are electrically isolated from one another and that are attached to the first side, wherein each patch comprises an edge that spirals around the core opposite the rotational direction; and a second plurality of electrically conductive patches that are electrically isolated from one another and that are attached to the second side, wherein each of the plurality of electrically isolated patches that are attached to the first side has a first thickness, and wherein each of the plurality of electrically isolated patches that are attached to the second side has a second thickness that is different than the first thickness.

23. A communication cable comprising:

a core that comprises a plurality of pairs of individually insulated electrical conductors, wherein each pair is individually twisted in a rotational direction, and wherein the core is twisted in the rotational direction;

a tape, curled around the core, that comprises:

a first edge extending substantially parallel to the communication cable;

a second edge extending substantially parallel to the communication cable;

a first side;

a second side; and a plurality of electrically conductive patches that are electrically isolated from one another and that are attached to the first side, wherein each patch comprises an edge that spirals around the core opposite the rotational direction; and a second plurality of electrically conductive patches, disposed adjacent the second side, that are electrically isolated from one another and from the plurality of electrically conductive patches, wherein the plurality of electrically conductive patches and the second plurality of electrically conductive patches circumferentially encase the core, wherein the communication cable is operative to carry a signal that comprises a frequency, wherein each of the plurality of electrically conductive patches is substantially thicker than a skin depth for the frequency, wherein the first side faces the core, wherein the second side faces away from the core, wherein each of the plurality of electrically conductive patches is thicker than each of the second plurality of electrically conductive patches, and wherein each of the plurality of electrically conductive patches and each of the second plurality of electrically conductive patches comprises a respective edge forming an acute angle with the first edge of the tape or the second edge of the tape.

24. The communication cable of claim 23, wherein each of the plurality of electrically conductive patches comprises a first length, and wherein each of the second plurality of electrically conductive patches comprises a second length that is substantially different than the first length.

25. The communication cable of claim 24, wherein each of the plurality of electrical conductive patches has a geometric form that is different than each of the second plurality of electrically conductive patches.

26. An apparatus for isolating an electrical conductor, comprising:

a strip of dielectric film comprising a first edge, a second edge, a first side between the first edge and the second edge, and a second side opposite the first side;

a first plurality of conductive film segments, each attached to the first side of the strip of dielectric film, wherein first isolation regions separate the first plurality of conductive film segments from one another; and a second plurality of conductive film segments, each attached to the second side of the strip of dielectric film, wherein second isolation regions separate the second plurality of conductive film segments from one another, wherein the first plurality of film segments overlap the second isolation regions, and wherein the first plurality of conductive film segments and the second plurality of conductive film segments spiral around a plurality of twisted pairs of electrical conductors in a common direction.

* * * * *